US006442915B1

(12) United States Patent
Kurth et al.

(10) Patent No.: US 6,442,915 B1
(45) Date of Patent: Sep. 3, 2002

(54) PROCESS AND PLANT FOR ENDLESS-CYCLE STERILIZATION OF SHEET MATERIAL UTILIZED IN ASEPTIC PACKAGING

(75) Inventors: Gunter Kurth, Ranstadt; Peter Walter, Ortenberg, both of (DE)

(73) Assignee: Hassia Verpackungsmaschinen GmbH, Ranstadt (DE)

( * ) Notice: Subject to any disclaimer, the term of this patent is extended or adjusted under 35 U.S.C. 154(b) by 0 days.

(21) Appl. No.: 09/448,332

(22) Filed: Nov. 23, 1999

(30) Foreign Application Priority Data

Nov. 27, 1998 (DE) ..... 198 54 804

(51) Int. Cl.[7] ..... B65B 55/04
(52) U.S. Cl. ..... 53/426; 53/425
(58) Field of Search ..... 53/425, 167, 426; 99/451, 453, 483; 426/521, 511; 422/26, 28; 239/161

(56) References Cited

U.S. PATENT DOCUMENTS 3,942,299 A * 3/1976 Bory ..... 53/425
4,055,035 A * 10/1977 Sjostrand et al. ..... 53/167
4,225,556 A * 9/1980 Lothman et al. ..... 422/28
4,537,007 A 8/1985 Lattanzi
4,543,770 A * 10/1985 Walter et al. ..... 53/167
4,627,221 A * 12/1986 Buchner ..... 53/425
5,387,403 A * 2/1995 Ikeuchi ..... 239/161
5,429,303 A * 7/1995 Winheim ..... 239/110

* cited by examiner

*Primary Examiner*—Scott A. Smith
*Assistant Examiner*—Nathaniel Chukwurah
(74) *Attorney, Agent, or Firm*—Collard & Roe, P.C.

(57) ABSTRACT

The invention is concerned with a process of sterilizing at least the load-sided surface of sheets of packing material by using saturated steam, and with an arrangement for carrying out the process.

According to the process, the saturated steam prior to application thereof to the sheet section contained in the sterilization passage chamber is converted by a controlled energy supply into superheated steam. The said superheated steam is jetted with substantially uniform intensity across the entire length of at least one transverse line of the sheet of packing material onto the sheet to form a uniformly thin condensate film on the sheet of packing material. The so sterilized sheet of packing material, while maintaining the sterile conditions, is then supplied to a packing machine connected thereto which also operates under sterile conditions.

20 Claims, 5 Drawing Sheets

PROCESS AND PLANT FOR ENDLESS-CYCLE STERILIZATION OF SHEET MATERIAL UTILIZED IN ASEPTIC PACKAGING

BACKGROUND OF THE INVENTION

1. Field of the Invention

The invention relates to a process and a plant for the sterilization of sheet material utilized for packaging pre-sterilized products in aseptic conditions.

2. Description of the Prior Art

Using steam for sterilizing purposes is generally known in the art. U.S. Pat. No. 4,537,007 as early as in 1985 taught to spray superheated steam onto a sheet of packing material passed through a sterilizing chamber, with the sheet of packing material being, however, previously moved through a relatively hot water bath held at a temperature immediately below the boiling point, and at the same time hermetically sealing the bottom inlet port of the sterilizing chamber.

It appears that the process according to U.S. Pat. No. 4,537,007 could not be realized in practice. The reasons herefore, in all probability, reside in that it is difficult for the sheets of packing material usually consisting of plastic material suitable for packing purposes to be uniformly wetted with water and that the said process does not produce a coherent and uniform condensate film on the sheet of packing material. However, a hot condensate film is mandatory for achieving reliably sterile conditions. Since, in addition, the sheet of packing material according to the process of U.S. Pat. No. 4,537,007 is heated by the hot water bath itself, entering the sterilization chamber wetted with drops of water only, if wetted at all, the effect of the superheated steam which apparently is to serve especially for drying the sheet of packing material, is non-uniform because the steam is applied both to wetted and unwetted areas of the sheet material. Moreover, the steam is already fed to the sterilizing chamber in superheated condition requiring a superheating aggregate outside the chamber and correspondingly insulated steam feeding conduits; in addition, it will have to be taken into consideration that, as a rule, only saturated steam networks are available in the installation rooms of packing machines.

One object of the invention described herein is that of providing a sterilization process, and plant herefore, with the aid of which supplied saturated steam first is economically transformed therein into superheated steam where it is needed to be jetted in the form of superheated steam onto the non-pretreated sheet of packing material entering in dried condition to form thereon a uniformly thin film of condensate.

SUMMARY OF THE INVENTION

The above objects and others besides are realized by the process and plant to which the invention refers, being of a type utilizing an endless sheet of material for subsequent shaping into a strip and/or a tube having cups shaped thereinto by deep drawing, and being characterized in that the sterilization process itself comprises the following steps: Sterilization is effected by means of steam jetted through at least one nozzle, with the aseptic sheet of packing material being subsequently introduced into a sterile tube of a packing machine, and the sterilization chamber and the sterile tube being held at a slight excess pressure relative to the atmosphere. In accordance with the invention, saturated steam is supplied to the nozzle, and the saturated vapor prior to being applied to the section of the sheet of packing material contained in the sterilization chamber and supplied in dry condition into the chamber, by a controlled energy supply, immediately before jetting is superheated and the superheated vapor is jetted with substantially uniform intensity across the entire length of at least one transverse line of the sheet of packing material onto the same while forming a condensate film.

The process of the invention to be described hereinafter in greater detail can be realized both with a movement of she sheet of packing material relative to the nozzle and in standstill condition of the sheet of packing material.

A process slightly differing from the afore-described process comprises the following steps: Here, sterilization is again effected by steam jetted through at least one nozzle, with the sterilized sheet of packing material being subsequently introduced into a sterile tube of a packing machine, and with the sterilization chamber and the sterile tube being held under a slight excess pressure relative to the atmosphere. In accordance with the invention, saturated steam is supplied to the nozzle, and the saturated steam prior to being applied to the section of sheet of packing material contained in the sterilization chamber and introduced in timed sequence and in dry condition into the chamber immediately before being jetted is superheated by a controlled energy supply. The said superheated steam, within a steam stowage space formed above the section of the sheet of packing material to be treated and held in closed condition during steaming, is jetted onto the sheet of packing material throughout the entire surface thereof with substantially uniform intensity, forming at the same time a condensate film.

After sterilization, according to both processes the sterilized sheet of packing material in sterile condition, within a tube, is moved into the packing machine to be formed therein also under sterile conditions, into packings then filed and sealed.

BRIEF DESCRIPTION OF THE DRAWINGS

The two processes of the invention only slightly distinguished from one another, the apparatus for carrying out the same and advantageous embodiments thereof will be described hereinafter in greater detail with reference to the drawing, wherein.

DETAILED DESCRIPTION OF THE PREFERRED EMBODIMENTS

Figure 1:
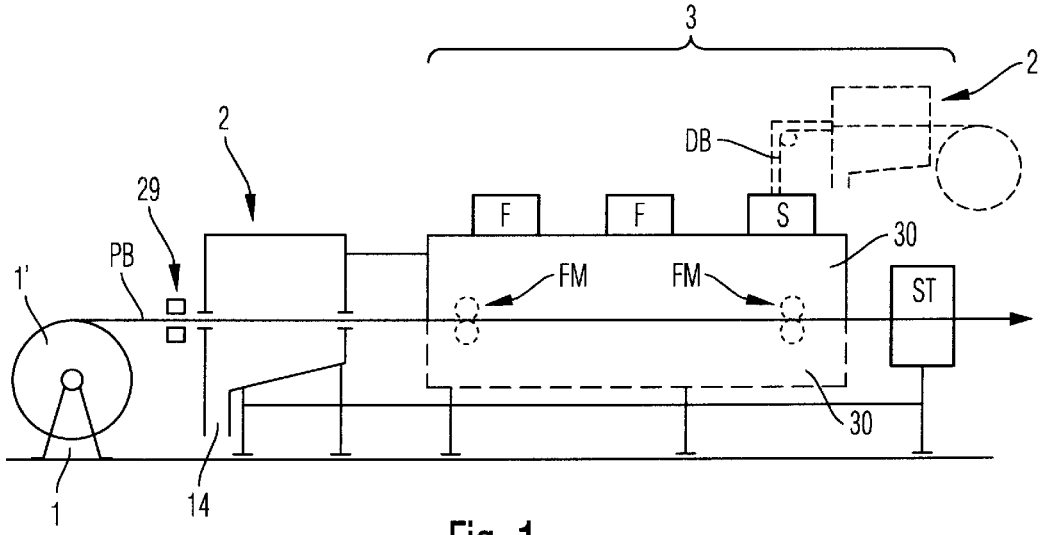
FIG. 1 schematically shows the apparatus of the invention in conjunction with a reprocessing unit coupled thereto for timed passage of the sheet of packing material.

The two processes of the invention and the related apparatus are in compliance with the requirements placed upon them because, on the one hand, a lower amount of saturated steam is consumed or to be supplied and because, on the other hand, the conversion thereof into hot steam prior to jetting thereof creates a low but nevertheless required amount of condensate and because the said condensate deposited in the form of a thin layer on the sheet of packing material introduced in dry condition and at room temperature and formed as a result of the temperature gradient between the hot steam temperature level and the temperature level of the sheet of packing material is specifically used for germ killing. Consequently, through converting the saturated steam into hot steam, in the practice of the invention, a "middle way" is thus chosen between an excessive and deficient amount of condensate which insures that, on the one hand, condensate required for sterilization is available in a substantially uniform thin layer, which, on the other hand, does not affect the heat passage toward the sheet of packing material PB which is likely to be the case in the event of an excessive amount of condensate forming puddles. The known principle of germ reduction by humid heat, hence, is maintained by using the superheated steam advantageous for the reduced formation of condensate. As to the phrases, "sterilization chamber" and "with substantially uniform intensity" relative to jetting, reference is made to the following:

The aseptic chamber 2 is a simple box-shaped and relatively large-volume housing having slot-type inlet and outlet ports 2', 2" for the sheet of packing material PB. As the steam is directly jetted onto the sheet of packing material at a small distance D (the distance of the nozzle mouth from the sheet of packing material is about 5–6 mm), the chamber 2 has no leading or guiding function for the hot steam relative to the sheet of packing material; such a function is not required because, as previously set forth, more or less superheated steam, depending on the energy supply, is directly jetted onto the sheet of packing material.

The second condition "with uniform intensity" relates to the shaping of the nozzle 5 under consideration of the width B of the sheet of packing material which is known to vary (depending on the reprocessing unit 3 or the width of the processing machine for the sheet of packing material) in the range of between 200 and 800 mm. Hence, steps will have to be taken in respect of the nozzle to insure that the jetting intensity also in wider sheets of packing material be uniform across the entire width thereof. The phrase "at least one nozzle" thus mans that not only two nozzles provided in the passage direction in series arrangement (see FIG. 4) but a plurality of nozzles corresponding to the width B of the sheet of packing material to be treated can be arranged in side-by-side relationship (see FIG. 5) respectively insuring in their operating range the corresponding jetting intensity. However, the term "nozzle" also refers to an embodiment to be explained in more detail (see FIGS. 8, 9) in the form of a so-called steam box which is intended for carrying out the second process.

The controlled energy supply to the nozzle is also of importance to thereby influence the degree of superheating of the saturated steam and, hence the development of condensate on the sheet of packing material which is to be as high as required but as low as possible to achieve an optimum germ reduction treatment of the sheet of packing material.

The said controlled supply also is effected under consideration of the temperature of the sheet of packing material entering in dry condition, i.e. the conventional need of bringing a new supply roll 1' of sheet of packing material to the temperature prevailing in the packing machine room is eliminated. If the incoming sheet of packing material still has a temperature below normal measured by temperature sensor 29, the amount of steam to be applied is correspondingly reduced as condensate is deposited in increased amounts on a colder surface.

Also, the saturated steam supply to the nozzle can be regulated or turned on and off, i.e. directly in relation to the nozzle jet intensity, on the one hand, and under consideration of the fact that the sheet of packing material, following the rhythm of the connected processing machine, is cyclically fed through sterile chamber 2, on the other hand, which is to be preferred because of the reduced mechanical efforts involved, for a mechanical transitory area involving high mechanical efforts (retarding loop guide) for a sheet of packing material PB continuously entering the aseptic chamber and then cyclically introduced into the following processing machine, is eliminated. However, this involves major control efforts, for the steam supply per passage cycle in that case must be so turned on and off as to comply with the condition of jetting the steam during advance of the sheet material. Regarding the said sheet material advance or movement thereof during jetting, it should be noted that this condition of movement can also be complied with in that during standstill of the sheet material either the whole of the chamber 2 together with the elements contained therein or merely the nozzle 5 in the chamber 2 then in standstill condition is moved. Advantageous embodiments arising in this connection will be explained in greater detail hereinafter.

Figure 2:
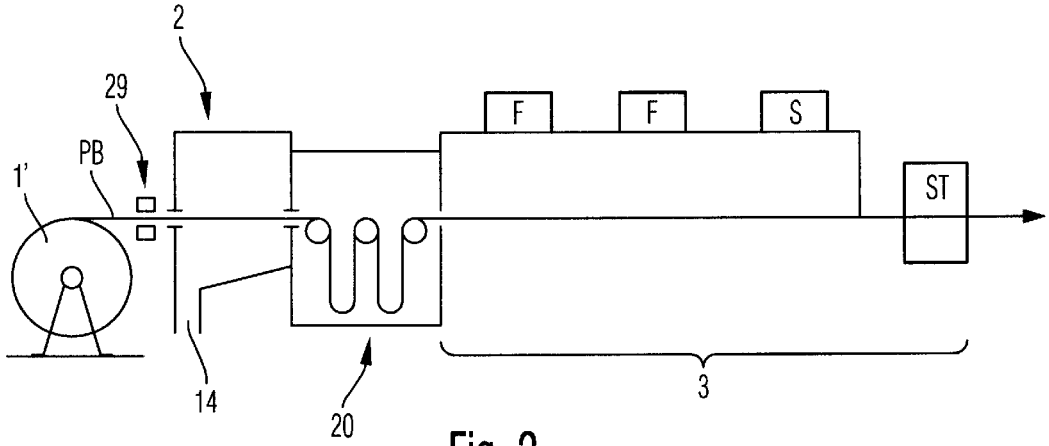
FIG. 2 is a view corresponding to the one of FIG. 1 for a continuous supply of the sheet of packing material to the apparatus of the invention and for subsequent timed advance into the reprocessing unit.

The apparatus for carrying out the first process comprises a holder 1 for holding the supply roll of the sheet material with an aseptic chamber 2 coupled thereto, and means for the controlled steam supply with an aseptic reprocessing unit 3 formed by a packing machine being arranged behind the chamber 2. The embodiment shown in FIGS. 1, 2 are deep-drawing machines forming a reprocessing unit 3 by which cups are molded, loaded and sealed on the cyclically moving sheet of packing material PB in the following stations F, F, S and, subsequently, the cups individually or in groups are separated from the sheet of packing material within the punching station ST. A corresponding chamber 2 shown in broken lines only to the right of FIG. 1, top, is arranged above the sealing station S for a web of cover foil DB to be supplied to the sealing stations S for which sterile conditions must, of course, also be maintained.

Figure 3:
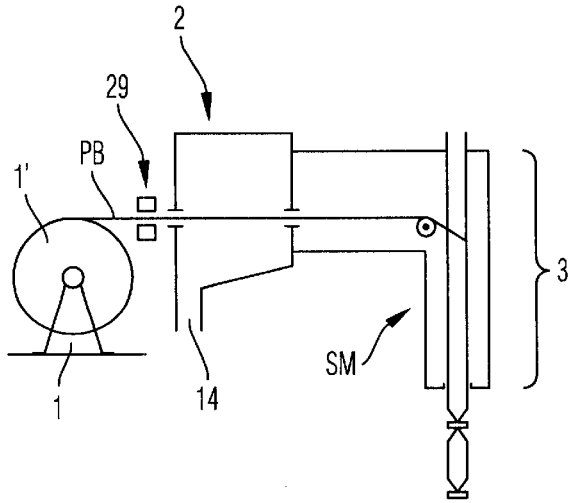
FIG. 3 shows the apparatus of the invention in conjunction with a packing machine coupled thereto for manufacturing tubular bags.

In the embodiment according to FIG. 1, the sheet of packing material PB is cyclically fed through the chamber 2 while according to FIG. 2 the continuous supply behind the chamber 2 is converted into an endless-cycle advance which requires a chamber 20 accommodating the retarding loops of the sheet of packing material. The means FM required for such advance movements and sheet guides are shown in FIG. 1 schematically only and in broken lines not requiring any special explanation as they are generally known in the art, especially so, as only the arrangement for the hot steam treatment of the non-deformed web of sheet material PB mounted ahead of the reprocessing unit 3 of whatever shape is of interest. It is only for the sake of completeness that FIG. 3 shows the sterilizing arrangement in conjunction with a packing machine SM for the manufacture of tubular bags.

Figure 4:
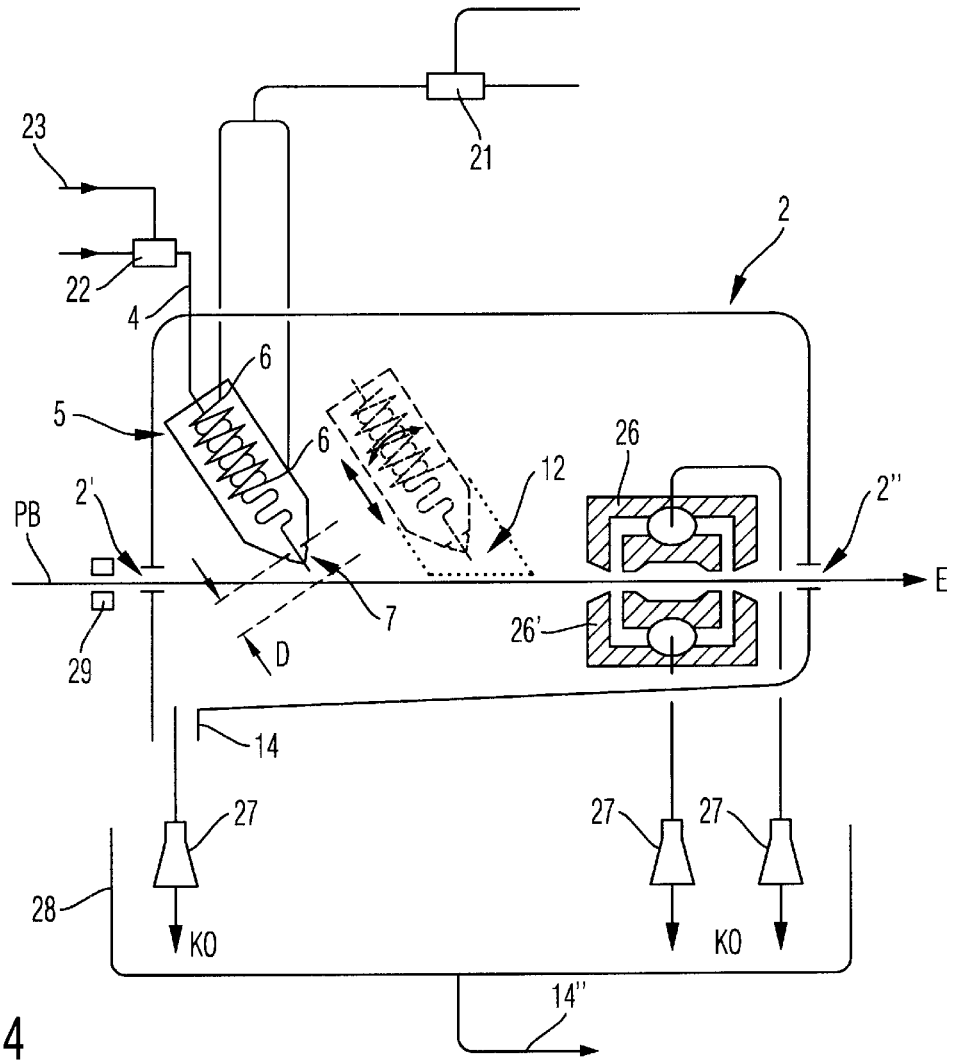
FIG. 4 is an enlarged view of the apparatus of FIG. 1 for carrying out the process.

It is of importance to the arrangement for carrying out the first process in reference to FIG. 4 that the steam supply be in the form of at least one nozzle 5 oriented substantially transverse of the direction of passage of the sheet of packing material and arranged within the sterile chamber 2 provided with a condensate discharge 14 at a small distance D above the plane E for the passage of the sheet of material and open at the bottom toward the atmosphere, with the internal steam guide 4 leading to the nozzle port 7 and being provided with a controllable or sensor-controlled energy supply means 6 (e.g. electrical heat resistor).

Reference numeral 21 in FIG. 4 refers to the control for the energy supply means 6, numeral 22 to the steam pressure- and steam quantity control and numeral 23 refers to the saturated steam supply conduit. Moreover, the chamber 2 is provided with a means 14 for the discharge of condensate deposited on the walls of the passage chamber.

With the aid of this arrangement, the saturated steam supplied in a controlled way through the conduit 23 and by the valve 22 prior to application thereof to the sheet of packing material PB in the nozzle itself is converted by a correspondingly controlled energy supply into superheated steam end is then jetted onto at least one side of the filling material of the sheet of packing material PB moved through the chamber 2 open against the atmosphere during advance thereof in a direction transverse thereto from a short distance D substantially with uniform intensity across the width B of the sheet of packing material, which has been found to result in an extremely efficient germ reduction.

Figure 5:
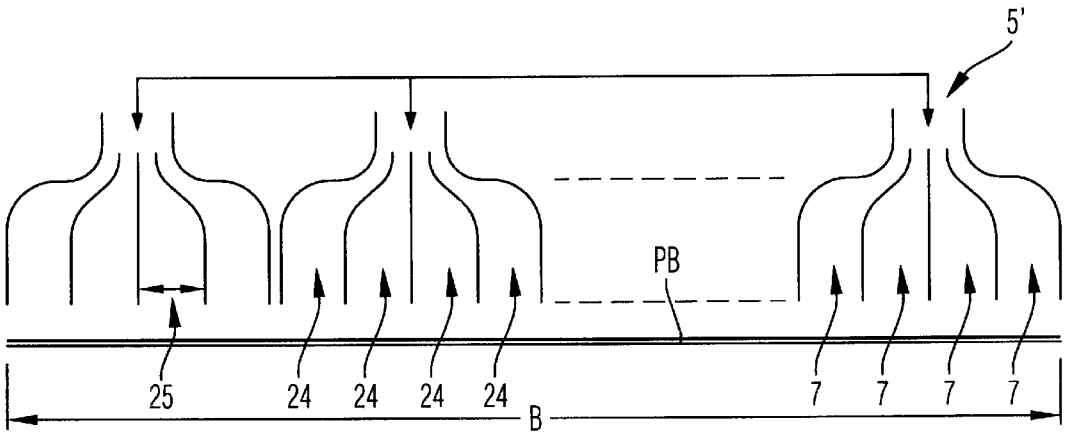
FIG. 5 schematically shows a sectional view of a nozzle.

The saturated steam supplied, for example, at 5.5 bar, with a nozzle 5 held at about 300° C. through energy supply via means 6, is discharged at about 200° C. The nozzle 5 is so shaped that the steam jetted throughout the entire width B of sheet material substantially is of a uniform and equal intensity. With a broad width of the sheet of packing material PB, this means that arranged within a nozzle head 5' (see FIG. 5) are a plurality of chambers 24 to which steam can be uniformly applied and which are provided with slitted ports 25 having a maximum width of between 10 and 20 mm. Depending on the width of the sheet material, a plurality of such nozzles are arranged within a nozzle head 5' in side-by-side relationship, only three of which are shown in FIG. 5. In case of a timed passage of sheet material through chamber 2 according to FIG. 1, the saturated steam supply is effected in corresponding cycles via a correspondingly controlled ON/OFF switch that can be integrated into controller 22, i.e. jetting is effected only if the sheet of packing material PB with the section concerned moves within the chamber 2. If the degree of sterilization so requires, it will be readily possible to provide two nozzles 5 or nozzle heads 5' in series arrangement, as shown in broken lines in FIG. 4.

If the sheet of packing material PB is to move continuously through the chamber 2, thus eliminating the need of providing an ON/OFF switch for the steam supply and thereby virtually insuring more uniform steaming conditions, then the first part of the sterile reprocessing unit 3 provided behind the sterile chamber 2 is in the form of a space 20 accommodating the retarding loops of the sheet of packing material in which also sterile conditions are to be maintained; arranged behind the space 20 are means FM for the periodical discharge of the sterile sheet of packing material PB. The means FM are only schematically shown, especially so as these are timed supply means of the packing machine connected thereto.

As shown in FIG. 4, a so-called condensate blade 26 is arranged in the chamber 2 behind the nozzle 5 in a direction transverse to the passage direction, which blade discharges the stripped-off condensate KO, for example, by means of an air-operated exhaust means 27 working on the principle of a venturi nozzle. The exhaust means 27 involves the advantage that it is completely insensitive, as opposed to the conventionally used vacuum pumps, to the killing media and the residues thereof. As the freely jetted steam expands throughout the whole of the chamber, depositing on the walls thereof, the chamber is, as previously mentioned, provided with a condensate discharge means 14 leading to a collecting unit 28 provided with a condensate discharge means 14' taking up the condensate KO from the condensate blade 26. The condensate discharge means 14 is also connected to an exhaust means 27 wherein a strong air blast is supplied to the condensate flow, thereby developing a suction effect on the condensate discharge means 14 (working on the principle of a venturi nozzle).

Under consideration of the steam distribution in the chamber 2, a condensate exhaust means 26' may be arranged on the bottom side of the sheet of packing material PB.

The same applies to the nozzle 5: if it is required to maintain aseptic conditions in the processing unit 3, (i.e. the bottom side of the sheet of packing material is fed under sterile conditions through a so-called full tube 30 (see FIG. 1)) equally at least one nozzle directed from the bottom against the sheet of packing material is arranged within the chamber 2.

The rule that the nozzle be arranged "at a small distance D from the sheet of packing material", refers to a distance in the order of between 4 and 8 mm. Preferably, the distance and slope of nozzle 5 within the chamber 2 is adjustable (see the arrows on the second nozzle shown in broken lines) so that optimum adjustments of distance and slope can be realized for the treated sheet of packing material. The slope of the nozzle in the passage direction as shown in FIG. 4 has proved to be particularly advantageous as the condensate film thereby formed on the sheet below the nozzle moves away from the nozzle along with the sheet of packing material.

Figure 6:
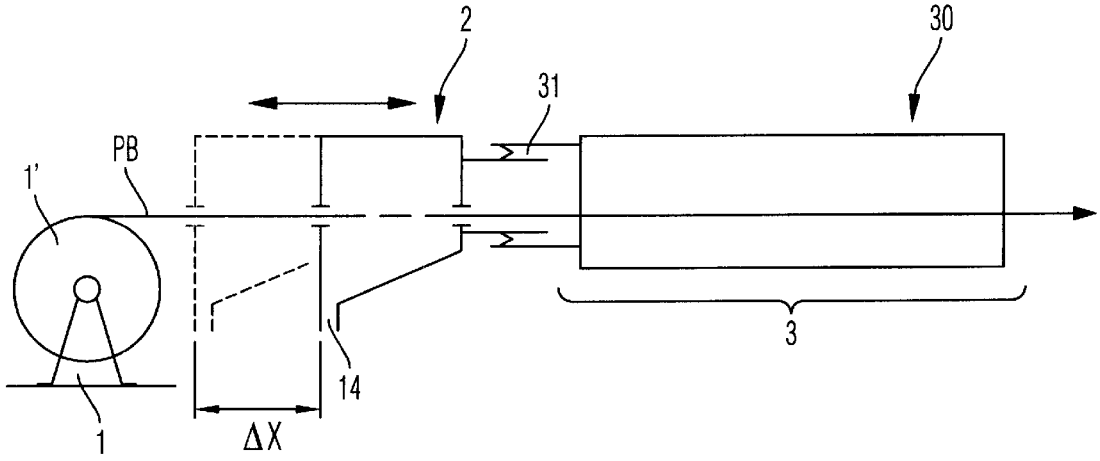
FIG. 6 schematically shows a special embodiment.
Figure 7:
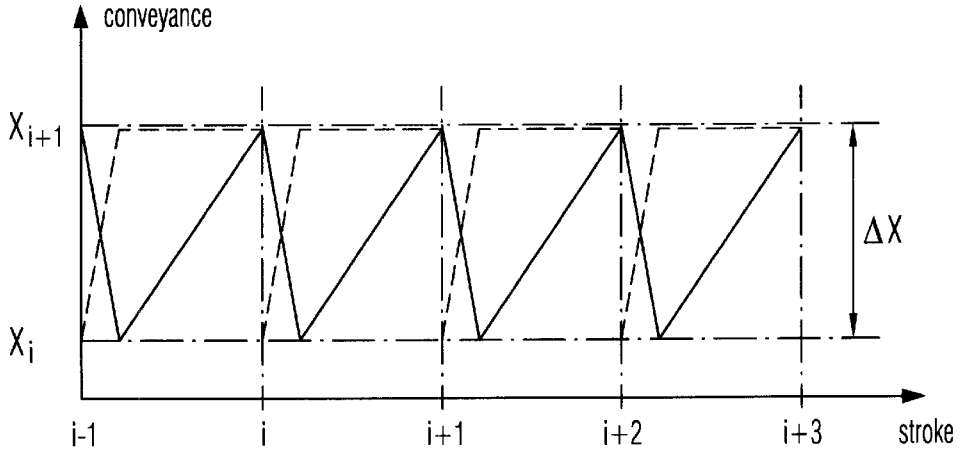
FIG. 7 shows a diagram of the sequence of motions of the sterilization chamber and of the sheet of packing material with the sterilization chamber cyclically moved.

In the afore-described embodiments, the application of steam is either continuous or periodical. In a continuous application of steam it will be necessary, as previously mentioned and as shown in FIG. 2, to provide a space 20 for accommodating the retarding loop of the sheet of packing material to insure a smooth advance of the sheet at the point of transition between continuous steaming and cyclical reprocessing. To avoid the need of providing such a space 20 accommodating the retarding loops of packing sheet, the chamber 2, as shown in FIG. 6, preferably is disposed displaceably and opposite the direction of movement of the sheet of packing material PB, with the path of displacement corresponding at least to the advance of the sheet per cycle. To explain the way of operation of the displaceably arranged sterile chamber 2 (displacing drive not shown), FIG. 7 shows a diagram of the sequences of movement of the advanced sheet of packing material (broken lines) and of the advance of the passage chamber 2 (broken lines) with respect to one another. It is of importance that the application of steam of the sheet of packing material be effected at the same time as, for example, the deep-drawing of the sheet of packing material already sterilized and that the span of time be used for the advance of the sheet of packing material for the return movement of the chamber 2. To insure a sterile transition from the chamber 2 to the reprocessing unit 3, it is of advantage, as schematically shown in FIG. 6, to provide between these two chambers a sealed telescopic housing 31 or a bellow.

In accordance with the second sterilization process which, basically, is only slightly distinguished from the afore-described process, it is so proceeded that saturated steam is supplied to the nozzle and the saturated steam prior to application to the sheet of packing material by a controlled energy supply immediately prior to jetting is superheated, and the superheated steam within a steam stowage space formed above the section of the sheet of packing material to be treated is jetted throughout the surface within the said space held closed during the application of steam to the sheet of packing material BP, at the same time forming a condensate film.

Figure 8:
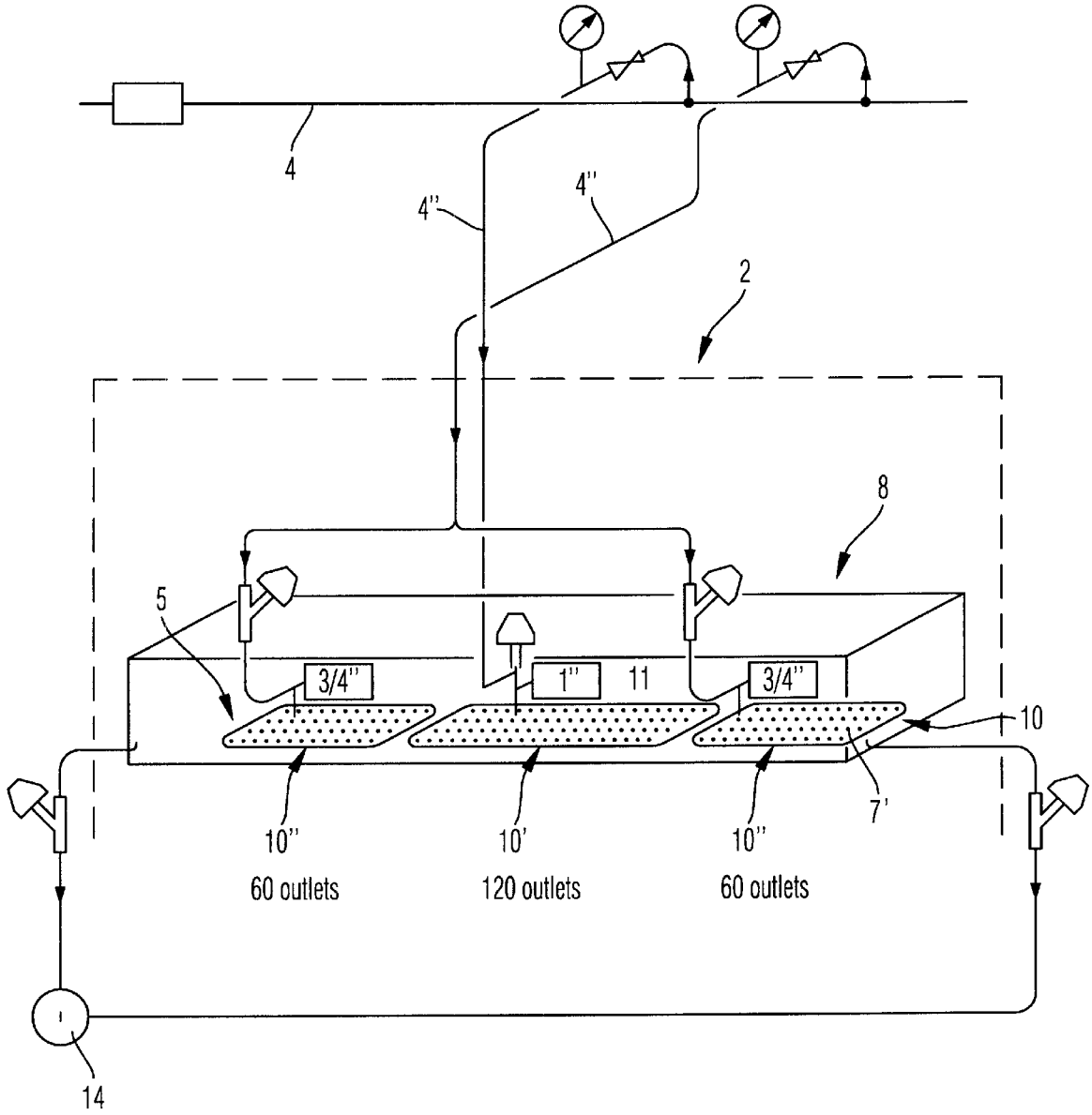
FIG. 8 is a perspective and schematically shown view of the preferred embodiment of the apparatus of the invention.
Figure 9:
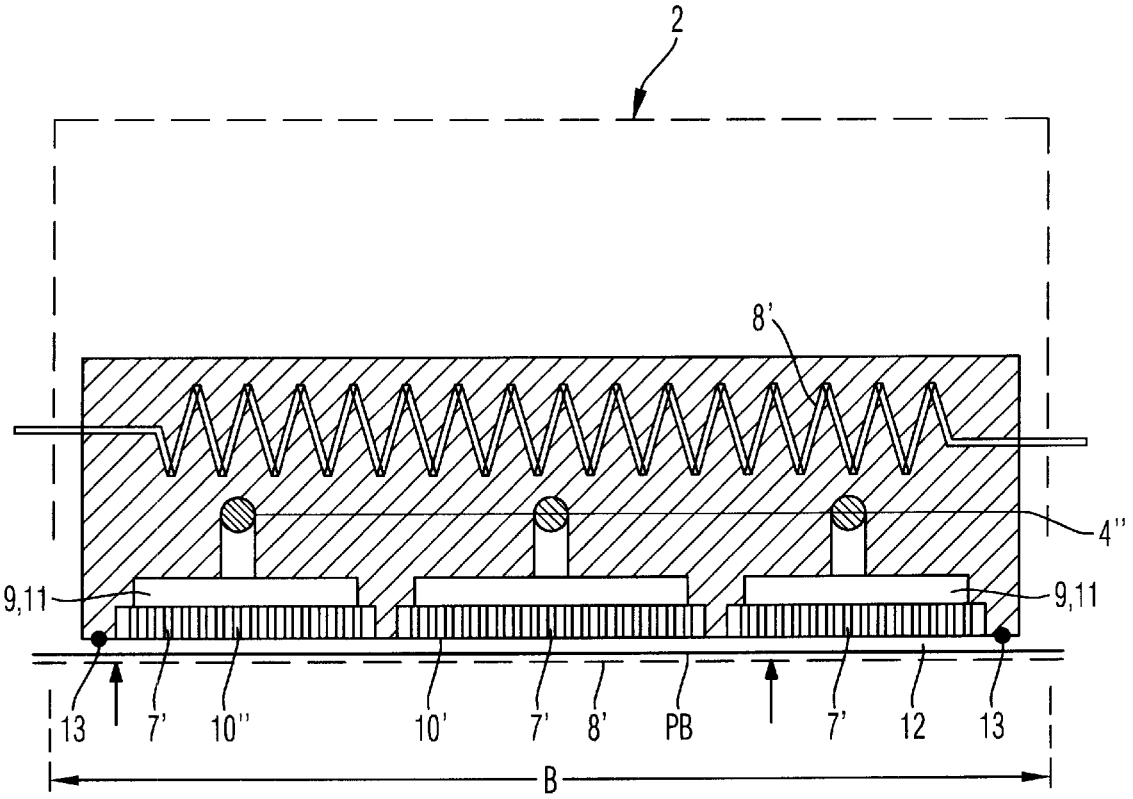
FIG. 9 schematically shows a longitudinal section of the nozzle according to FIG. 7.

For this purpose, the nozzle 5 according to FIGS. 8, 9 is designed in the form of a heatable steam box 8 having an internal steam distributing chamber 9 sealed against the passage plane E of the sheet of packing material by a nozzle plate 10 comprising a plurality of nozzle ports 7'. The nozzle plate 10, preferably, is formed of a central section 10' and of two marginal sections 10" whose separately held distributing chambers 11 are connected to separate, controllable conduits 4" supplying the saturated steam. On the side of the sheet of packing material, the steam box 8 is provided with a sealant 13 confining a steam stowage chamber 12. Depending on the design of the sealant 13, the so formed arrangement can be operated by having the sheet of packing material PB passed either in cycles or continuously. If the sealant 13 is formed as shown in FIG. 9, i.e. in the form of an O-ring sealant around the circumferential contour of the box, the stopped sheet section, with a plate 811 only shown in broken lines in FIG. 9, is forced from the bottom against the sealant 13 so that a closed steam stowage space 12 is available for jetting hot steam onto the whole surface, whereafter the plate 81" is again slightly lowered. The residual steam (saturated steam/wet steam) can then escape into the chamber 2.

Also, the sealant 13 can be in the form of a circumferential lip-type packing more or less resilient (not shown in any detail) which then also confines a steam stowage chamber 12 which, however, remains circumferentially open by a narrow gap between sealant 13 and sheet of packing foil PB. In a continuous application of hot steam, the sheet of packing material also can be continuously supplied underneath the steam box 8 which, depending on the type of operation of the coupled packing machine, may require, as previously mentioned, a retarding loop guide 20 of the sheet of packing material PB as shown in FIG. 2.

The configuration of such a steam stowage space 12 which, incidentally, may also be provided in nozzles 5 according to FIG. 4 (shown therein in dotted lines) has proved to be advantageous because also the marginal areas of a moving sheet of packing material have been found to be reliably covered to achieve optimum degermination.

In the embodiment according to FIG. 9, the steam box 8 forming the "nozzle" is furnished with a controllable electrical heat resistor 8' maintaining the whole upper section of the box 8 also containing the saturated steam distributing conduits 4" at the proper temperature for converting the saturated steam into hot steam.

What is claimed is:

1. A process for germ reduction and cleaning at least one surface on a loading side of a sheet of packing material, which comprises the steps of (a) introducing the sheet of packing material in dried condition into a sterilization chamber and moving the sheet through the sterilization chamber in an operating direction, (b) jetting superheated steam to the dry surface through a nozzle in the sterilization chamber, (1) saturated steam being supplied to the nozzle and the steam being superheated by a controlled energy supply in the nozzle immediately prior to being jetted, and (2) the superheated steam being jetted with substantially uniform intensity over the entire length of at least one transverse line of the sheet of packing material to form a condensate film, and (c) subsequently introducing the sheet of packing material coming out of the sterilization chamber into an aseptic tube of a packing machine, (1) the sterilization chamber and the aseptic tube being held under a pressure slightly exceeding atmospheric pressure.

2. The process of claim 1, wherein the condensate film is exhausted from the sterilization chamber before the sheet of packing material leaves the chamber.

3. The process of claim 1, wherein the superheated steam is jetted at an inclination to the sheet of packing material in the operating direction.

4. The process of claim 1, wherein the sheet of packing material is moved relative to the nozzle while the superheated steam is jetted to the surface.

5. The process of claim 1, wherein any excess steam in the sterilization chamber is exhausted therefrom.

6. The process of claim 1, wherein the energy for superheating the steam is controlled in response to the temperature of the sheet of packing material introduced into the sterilization chamber.

7. A process for germ reduction and cleaning at least one surface on a loading side of a sheet of packing material, which comprises the steps of (a) introducing the sheet of packing material in dried condition into a sterilization chamber and cyclically moving the sheet through the sterilization chamber in an operating direction, (b) jetting superheated steam through a nozzle with substantially uniform intensity to the entire dry surface in a steam stowage space formed in the sterilization chamber while the steam stowage space is sealed, (1) saturated steam being supplied to the nozzle and the steam being superheated by a controlled energy supply in the nozzle immediately prior to being jetted, and (2) the superheated steam forming a condensate film over the entire surface, and (c) subsequently introducing the sheet of packing material coming out of the sterilization chamber into an aseptic tube of a packing machine, (1) the sterilization chamber and the aseptic tube being held under a pressure slightly exceeding atmospheric pressure.

8. An apparatus for germ reduction and cleaning at least one surface on a loading side of a sheet of packing material, which comprises (a) a supply roll of a dry sheet of packing material, (b) a sterilization chamber arranged to receive the dry sheet of packing material from the supply roll and to move the sheet through the sterilization chamber in an operating direction, (c) a nozzle extending over the width of the sheet of packing material arranged in the sterilization chamber, (d) controllable means for feeding saturated steam to the nozzle, (e) a controlled energy supply for superheating the saturated steam in the nozzle, (1) the nozzle having means for jetting the superheated steam through a port with substantially uniform distribution over the entire width of the dry sheet of packing material to form a condensate film, and (f) an aseptic tube of a packing machine arranged to receive the sheet of packing material from a discharge port of the sterilization chamber, (1) the sterilization chamber and the aseptic tube being held under a pressure slightly exceeding atmospheric pressure.

9. The apparatus of claim 8, further comprising an exhaust means arranged within the sterilization chamber downstream of the discharge port for exhausting the condensate film.

10. The apparatus of claim 8, wherein the controlled energy supply is arranged on a section of the controllable feeding means for the saturated steam immediately downstream of the nozzle port.

11. The apparatus of claim 8, wherein the nozzle is arranged at an inclination to the sheet of packing material which is adjustable in the operating direction.

12. The apparatus of claim 8, wherein the nozzle is arranged at an adjustable distance from the sheet of packing material.

13. The apparatus of claim 8, wherein the sterilization chamber comprises a discharge for condensate formed therein.

14. The apparatus of claim 8, further comprising a temperature sensor for sensing the temperature of the sheet of packing material, the temperature sensor being arranged downstream of an inlet port of the sterilization chamber.

15. An apparatus for germ reduction and cleaning at least one surface on a loading side of a sheet of packing material, which comprises (a) a supply roll of a sheet of packing material, (b) a sterilization chamber arranged to receive the sheet of packing material from the supply roll and to move the sheet along a conveying plane through the sterilization chamber in an operating direction, (c) a steam box extending over the entire surface of the sheet of packing material arranged in the sterilization chamber, the steam box being cyclically movable towards and away from the conveying plane and comprising (1) a nozzle plate defining a multiplicity of jet ports for jetting and uniformly distributing steam over the entire surface to form a condensate film thereover, the nozzle plate enclosing at least one steam distribution chamber in the steam box, (d) controllable means for feeding saturated steam to the steam distribution chamber, (e) a controlled energy supply in the steam box for superheating the saturated steam, and (f) an aseptic tube of a packing machine arranged to receive the sheet of packing material from a discharge port of the sterilization chamber, (1) the sterilization chamber and the aseptic tube being held under a pressure slightly exceeding atmospheric pressure.

16. The apparatus of claim 15, further comprising an exhaust means arranged within the sterilization chamber downstream of the discharge port for exhausting the condensate film.

17. The apparatus of claim 15, wherein the steam box further comprises sealing means facing the conveying plane for closing the steam distribution chamber when the steam box is moved towards the conveying plane.

18. The apparatus of claim 15, wherein the nozzle plate is comprised of a center section and two marginal sections, each section enclosing a separate steam distribution chamber, and the controllable steam feeding means feeding the saturated steam separately to each steam distribution chamber.

19. A process for germ reduction and cleaning at least one surface on a loading side of a sheet of packing material, which comprises the steps of (a) introducing the sheet of packing material in dried condition into a sterilization chamber and moving the sheet cyclically through the sterilization chamber in an operating direction, (b) correspondingly cyclically jetting superheated steam to the surface through a nozzle in the sterilization chamber, (1) saturated steam being supplied to the nozzle and the steam being superheated by a controlled energy supply in the nozzle immediately prior to being jetted, and (2) the superheated steam being jetted with substantially uniform intensity over the entire length of at least one transverse line of the sheet of packing material to form a condensate film, and (c) subsequently introducing the sheet of packing material coming out of the sterilization chamber into an aseptic tube of a packing machine, (1) the sterilization chamber and the aseptic tube being held under a pressure slightly exceeding atmospheric pressure.

20. A process for germ reduction and cleaning at least one surface on a loading side of a sheet of packing material, which comprises the steps of (a) introducing the sheet of packing material in dried condition into a sterilization chamber and cyclically moving the sheet through the sterilization chamber in an operating direction, (b) jetting superheated steam through a nozzle with substantially uniform intensity to the entire surface in a steam stowage space formed in the sterilization chamber while the steam stowage space is sealed, (1) saturated steam being supplied to the nozzle and the steam being superheated by a controlled energy supply in the nozzle immediately prior to being jetted, and (2) the superheated steam forming a condensate film over the entire surface, (3) the steam stowage space is opened after the condensate film is formed, and (4) the condensate film is exhausted from the sterilization chamber before the sheet of packing material leaves the chamber, and (c) subsequently introducing the sheet of packing material coming out of the sterilization chamber into an aseptic tube of a packing machine, (1) the sterilization chamber and the aseptic tube being held under a pressure slightly exceeding atmospheric pressure.

* * * * *